United States Patent [19]

Ishida et al.

[11] Patent Number: 4,883,969

[45] Date of Patent: Nov. 28, 1989

[54] METHOD OF IONIZING GAS WITHIN CATHODE-CONTAINING CHAMBER

[75] Inventors: Yoshihiro Ishida, Kawaguchi; Akira Yoshida, Urawa; Hideo Kobayashi, Tokyo, all of Japan

[73] Assignee: Texas Instruments Incorporated, Dallas, Tex.

[21] Appl. No.: 314,330

[22] Filed: Feb. 21, 1989

Related U.S. Application Data

[63] Continuation of Ser. No. 82,604, Aug. 6, 1987, abandoned.

[30] Foreign Application Priority Data

Aug. 13, 1986 [JP] Japan ..... 61-189994

[51] Int. Cl.[4] ..... H01J 27/00

[52] U.S. Cl. ..... 250/427; 250/423 R; 313/359.1; 315/111.81

[58] Field of Search ..... 250/423 R, 426, 427; 313/359.1, 362.1; 315/111.81

[56] References Cited

U.S. PATENT DOCUMENTS 3,406,283 10/1968 Williams ..... 250/426
3,916,034 10/1975 Tsuchimoto ..... 315/111.01
3,924,134 12/1975 Uman ..... 313/362.1
4,123,686 10/1978 Keller et al. ..... 313/230
4,658,143 4/1987 Tokiguchi et al. ..... 250/423 R

*Primary Examiner*—Bruce C. Anderson
*Attorney, Agent, or Firm*—William E. Hiller; N. Rhys Merrett; Melvin Sharp

[57] ABSTRACT

Method of ionizing a gas within a chamber having a cathode disposed therein, wherein the sputtering effect upon the cathode is substantially reduced to prolong the life of the cathode. The cathode within the chamber is initially activated to emit thermal electrons by applying a voltage thereto. The gas to be ionized is then introduced into the chamber along with an active gas. Ionization of the gas to be ionized is then achieved by subjecting the gas to be ionized to the thermal electrodes emitted by the cathode. The voltage applied to the cathode and the voltage between the cathode and the wall of the chamber are regulated so as to maintain a substantially constant electric arc current flowing from the wall of the chamber to the cathode. A predetermined mixture ratio is maintained as between the active gas and the gas to be ionized within the chamber so as to induce growth in the volume of the cathode at least partially offsetting the removal of atoms from the cathode caused by sputtering, the predetermined mixture ratio being maintained by controlling the introduction of the active gas into the chamber.

14 Claims, 3 Drawing Sheets

METHOD OF IONIZING GAS WITHIN CATHODE-CONTAINING CHAMBER

This application is a continuation, of application Ser. No. 082,604, filed Aug. 6, 1987.

BACKGROUND OF THE INVENTION

1. Field of the Invention

The present invention relates to a method of ionizing a gas, and more particularly to a method of ionizing a gas within a cathode-containing chamber in which ionization of the gas is caused by the collision of thermoelectrons emitted by the cathode.

2. Description of the Prior Art

An ion implantor such as a Freeman type hot cathode ion source is shown in FIG. 7, to which reference should now be made.

A hot cathode 1 is heated by an electric current in the range of tens to hundreds amperes flowing through it to emit hot thermoelectrons. An electric voltage E1 in the range of tens to hundreds volts is applied between the hot cathode 1 and an ion chamber 4. Under these conditions a gas conduit 3 introduces a gas for ionization such as boron trifluoride, ($BF_3$), phosphorus trifluoride ($PF_3$) or arsenic as vapor. The gas collides with thermoelectrons and as a result is ionized to form a plasma in the ion chamber. A magnetic field is usually applied in parallel with the hot cathode 1 for increasing the mean free path of thermoelectrons and increasing the number of collision between the thermoelectrons and the supplied gas. This action results in increased an in the ion density and thus in a higher plasma density. Application of a of a voltage E2 between the ion chamber 4 and a withdrawing electrode 5 withdraws from the plasma through a slit through a slit 9 on the side of the ion chamber 4. In FIG. 7, the reference characters are designated as follows: 2 insulating material, 6 a power source of the hot cathode (filament), 7 a power source for producing arcs and 8 a power source for withdrawing ions.

In the ion source structured as mentioned above the cathode 1 is bombarded with cations in the plasma in the ion chamber 4 and, owing to the resulting sputtering effect, becomes thinner and thinner with time, and eventually the ion source becomes unusable. In an intermediate current ion implantor (this type is exemplified as ion source unless specified otherwise hereinafter), a tungsten hot cathode 1 is subjected to spattering, that results in becoming very thin as shown in FIG. 3 in several hours, and thus has only a short life of up to 100 hours, and requires a high frequency of replacements of cathodes.

OBJECTS AND SUMMARY OF THE INVENTION

An object of the present invention is to provide a method of ionizing a gas within a cathode-containing chamber free of the above-mentioned defect that the cathode is subjected to breakdown, and thus prolonging the life of the cathode.

The above-mentioned object is accomplished in such a way that an ion generator comprises an ion chamber for ionizing a gas having a cathode disposed in the ion chamber and a conduit for introducing the gas into the ion chamber wherein the gas to be ionized and at least one active gas are simultaneously introduced into the ion chamber, following activation of the cathode to emit thermal electrons within the chamber by applying a voltage to the cathode. The gas to be ionized is then subjected to the thermal electrodes emitted by the cathode, thereby being ionized, while a predetermined mixture ratio is maintained between the gas to be ionized and the active gas within the chamber to induce growth in the volume of the cathode at least partially offsetting the removal of atoms from the cathode caused by sputtering.

Other objects, features and advantages of the invention will appear more fully from the following detailed description thereof taken in connection with the accompanying drawings.

DESCRIPTION OF THE PREFERRED EMBODIMENTS

Figure 1:
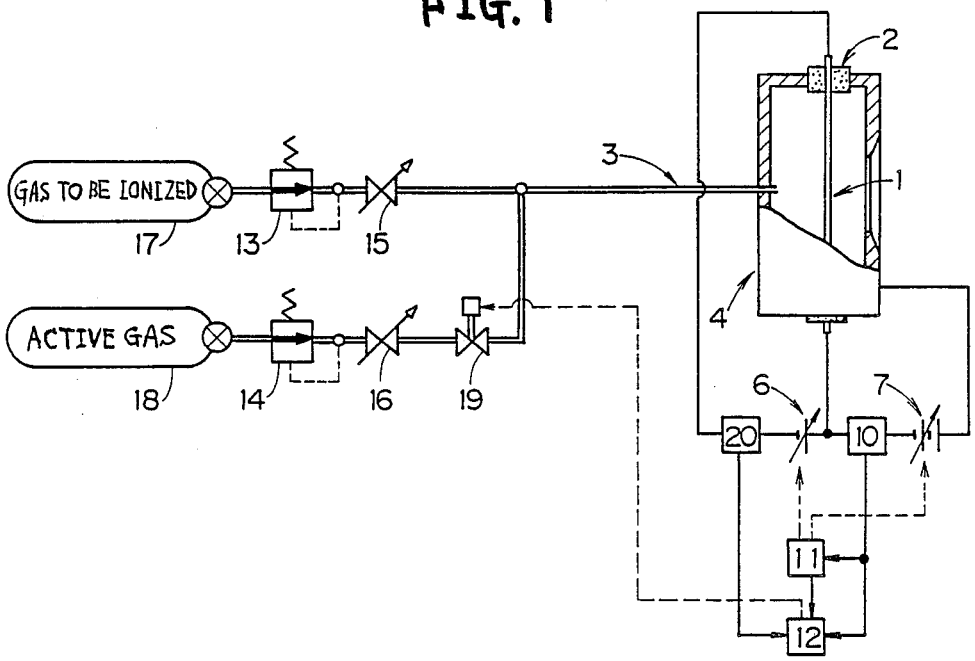
FIG. 1 is a schematical diagram of a hot cathode type ion source according to the invention.
Figure 7:
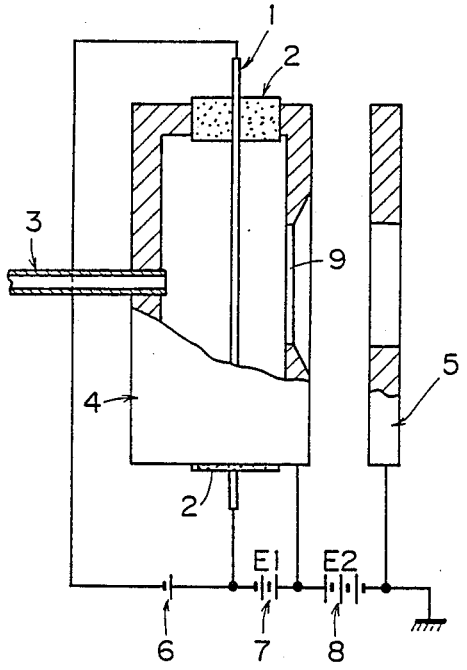
FIG. 7 PRIOR ART
FIG. 7 is a schematic diagram of a prior art hot cathode type ion source.

An embodiment of the invention will be described in detail with reference to the accompanying drawings hereinafter:

FIG. 1 illustrates an ion source according to the invention for supplying boron or phosphorus ions to an intermediate current ion implantor. The corresponding parts or components to those shown in FIG. 7 are designated by the same reference numerals.

A hot cathode of filament 1 (referred to as filament hereinafter) is supplied with power from a power source 6 and emits thermoelectrons, to which a voltage 7 between the filament 1 and an ion chamber 4 (referred to as arc voltage hereinafter) and a magnetic field (means for generating it is not shown) parallel to the hot cathode 1 are applied. Under these conditions, the thermoelectrons ionize a gas such as $BF_3$ or $PF_3$ introduced through a gas conduit 3, and thus a plasma is produced in the ion chamber 4. In obtaining a desired plasma, the power sources 6, 7 are adjusted so that the electric current flowing from the ion chamber 4 to the filament 1 (referred to as arc current hereinafter) is regulated to remain constant by an arc regulator 11 which receives signals from an arc current sensor 10.

When a valve 19 is in the closed position, the filament 1 becomes thinner and thinner in the course of time as the result of sputtering. The waste rate is proportional to the arc voltage and arc current and the waste is estimated from the current flowing in the filament (referred to as filament current hereinafter). The filament current is sensed by a current sensor 20. An active gas automatic controller 12 receive signals from the current sensor 20, and arc regulator 11, and controls of the opening and closing of the valve 19. In FIG. 1 reference characters designated as follows: 13, 14 gas regulator, 15, 16 variable valve for gas flow, 17 a tank of gas to be ionized, 18 a tank of active gas such as $O_2$ and 19 a remote controlled valve. If gasified, any substance may be suitable gas to be ionized. The active gas means no inactive gas.

Figure 2:
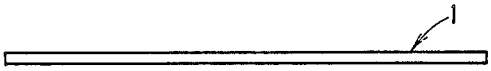
FIG. 2 is a front view of an unused cathode filament.
Figure 3:
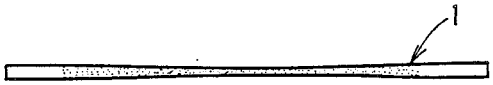
FIG. 3 PRIOR ART
FIG. 3 is a front view of a thinned cathode filament due to sputtering.
Figure 4:
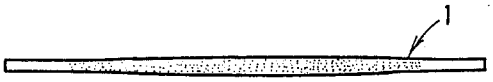
FIG. 4 is a front view of a grown cathode filament.

Referring to the apparatus shown in FIG. 1, it has been demonstrated by the inventors that when the apparatus was running to produce plasma while a gas to be ionized and an active gas such as $O_2$ were simultaneously introduced in the ion chamber, the inner surface of the ion chamber wall became a vapor, a portion of which was deposited onto the hot cathode and played a part of the latter. For example, by the use of $BF_3$ as a gas to be ionized $O_2$ as an active gas in a $BF_3$ to $O_2$ ratio of 85% to 15%, and an ion chamber of molybdenum and a tungsten hot cathode of 2 mm in diameter and 80 mm long, the hot cathode 1 (as one before use is shown in FIG. 2) grew about 1.3 times larger in about five hours as shown in FIG. 4. In view of these, if introduction of active gas is so controlled that sputtering of the hot cathode 1 may be offset by the above-stated growth of it, waste or at the worst breakdown of the cathode 1 could be prevented, and prolong the life thereof.

Figure 5:
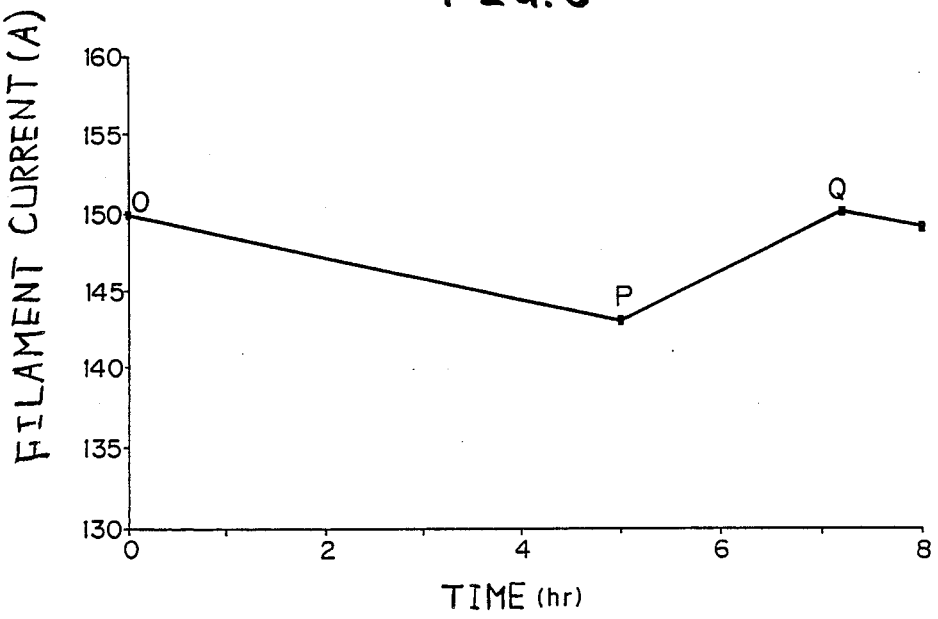
FIG. 5 is a graph representing the change in filament current with time in the embodiment of FIG. 1 by the use of $PF_3$.

In an alternative embodiment of the present invention, using $PF_3$ as a gas to be ionized, $O_2$ as an active gas in a $PF_3$ to $O_2$ ratio of 85% to 15%, an ion chamber of molybdenum and a tungsten hot cathode of 2 mm in diameter and 80 mm long, the arc voltage was regulated at 100 V and the arc current at 0.5 A. The obtained results were plotted in FIG. 5, in which the section O-P exhibits a change in filament current with time when the valve 19 was in the closed position, and section P-Q indicates the change when the valve 19 is in the opened position. There is an increase of filament current associated with growth of the filament.

The automatic controller 12 performs the functions of calculating the amount of filament from values of filament current, filament voltage, arc voltage and arc current, and controls the valve 19 so that the filament amount may be within a predetermined range, with the effects to enable the filament to be semi-permanently and thus permits the ion source to have a prolonged life.

Figure 6:
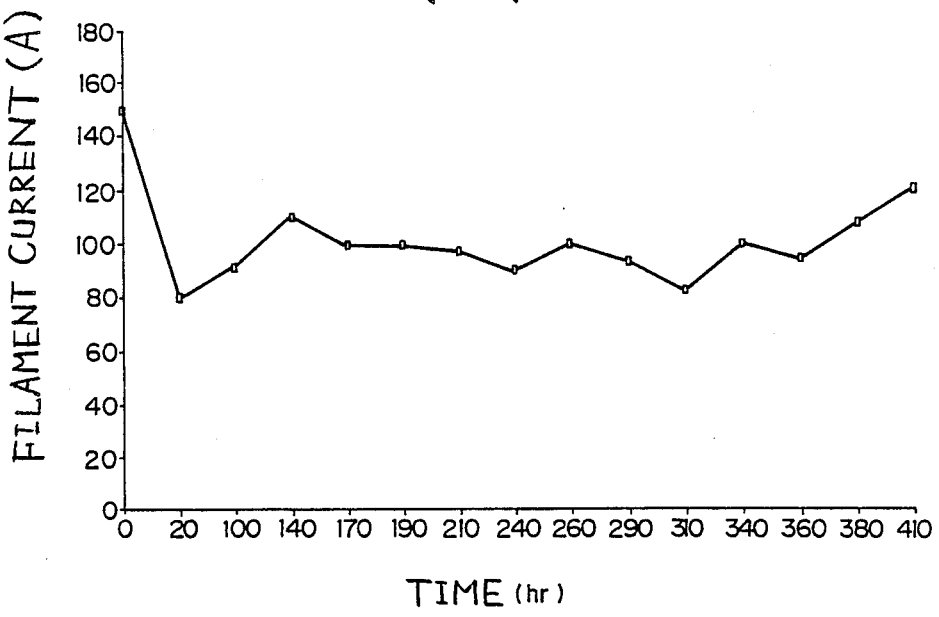
FIG. 6 is a graph representing the change in filament current with time in an alternative embodiment with the boron ion source under the same control as the embodiment of FIG. 1.

As described in the embodiment involved in FIG. 1, simultaneous introduction of a gas to be ionized and an active gas causes the filament 1 to grow as the result of the actions of themselves or their synergistic effect, and thus the filament can have semi-permanent durability. Additionally with the control set to cause the amount of filament to be constant, the cycle: sputtering from the filament—deposition onto the inner surface of the ion chamber wall and evolution from there—redeposition onto the filament, can be established, which contributes to less deterioration of the ion chamber a much prolong life of the ion source. A boron ion source with the same control as involved in FIG. 1 was caused to run for conventional ion implantor, and the results were plotted in FIG. 6 as change of filament current with the passage of time, which demonstrates the great effect of the invention.

In the embodiment involved in FIG. 1, the control is accomplished in such a way that a certain amount of a gas to be ionized is fed and thereafter an active gas is intermittently fed as desired. On the other hand, a similar effect may be produced either by controlling flow rate of active gas or by the use of a mixed gas at the mixing ratio of which sputtering rate and growth rate are in equilibrium. The mixed gas is fed from a sole tank.

Active gases other than $O_2$, such as $CO_2$ or $H_2O_2$ may be used. The active gas is supplied in an alternative way, for example, separately from gas to be ionized. In view of the fact that, the deposition of the evolved substance from the ion chamber wall permits the object of the invention as stated above, the use of an active gas containing a high melting point metal such as $WF_6$ or $MoF_6$ is capable of being deposited as a part of the filament and may be preferred.

Some gases when ionized will not take the above-mentioned effect by the use of an active gas alone. In such a case, two or more active gases may be used. As understood from the above-mentioned, the present invention of which object resides in enabling the filament to be durable semi-permanently is characterized in simultaneous introduction of a gas to be ionized and at least one active gas and thus is independent of active gas used and of the number of active gases used. Filament and ion chamber may be made of high melting point metal such as Mo, W or Ta or other material. The invention may be applied to any ion source provided with a hot cathode, without being limited to the ion source for an ion implantor exemplified above. Further an ion withdrawing electrode as mentioned referring to FIG. 7 may be provided.

It will be evident that various modifications can be made to the described embodiments without departing from the scope of the present invention.

The advantages of the present invention reside in that, simultaneous introduction of a gas to be ionized and at least one active gas causes growth of the cathode as the result of the synergistic effect of them and the sputtering effect of the active gas, and the cycle consisting of sputtering of the cathode, deposition onto the inner surface of the ion chamber and evolution from there, and redeposition onto the cathode is established, contributing to less deterioration of the chamber and cathode and enabling to bring very prolonged life ion generator into being.

What is claimed is:

1. A method of ionizing a gas within a chamber having a cathode disposed therein, wherein the sputtering effect upon the cathode is substantially reduced to prolong the life of the cathode, said method comprising:

activating the cathode to emit thermal electrons therefrom within the chamber by applying a voltage thereto;

introducing a gas to be ionized into the chamber having the cathode therein;

introducing at least one active gas into the chamber having the cathode therein;

ionizing the gas to be ionized by subjecting the gas to be ionized to the thermal electrons emitted by the cathode; and controlling the introduction of said at least one active gas into the chamber to maintain a predetermined mixture ratio with the gas to be ionized within the chamber to induce growth in the volume of the cathode at least partially offsetting the removal of atoms from the cathode caused by the sputtering effect.

2. A method as set forth in claim 1, wherein the introduction of said at least one active gas into the chamber is conducted simultaneously with the introduction of the gas to be ionized into the chamber.

3. A method as set forth in claim 1, wherein the wall of the chamber into which the gas to be ionized is introduced is made of molybdenum.

4. A method as set forth in claim 3, wherein the cathode within the chamber is a tungsten filament.

5. A method as set forth in claim 1, wherein the gas to be ionized as introduced into the chamber is boron trifluoride.

6. A method as set forth in claim 5, wherein said at least one active gas as introduced into the chamber is oxygen.

7. A method as set forth in claim 6, wherein the predetermined mixture ratio between said gas to be ionized and said at least one active gas is maintained within the chamber at approximately 85 percent boron trifluoride and 15 percent oxygen.

8. A method as set forth in claim 1, wherein the gas to be ionized as introduced into the chamber is phosphorous trifluoride.

9. A method as set forth in claim 8, wherein said at least one active gas as introduced into the chamber is oxygen.

10. A method as set forth in claim 9, wherein the predetermined mixture ratio between said gas to be ionized and said at least one active gas is maintained within the chamber at approximately 85 percent phosphorous trifluoride and 15 percent oxygen.

11. A method as set forth in claim 1, wherein said at least one active gas as introduced into the chamber is carbon dioxide.

12. A method as set forth in claim 1, wherein said at least one active gas as introduced into the chamber is hydrogen peroxide.

13. A method of ionizing a gas within a chamber having a cathode disposed therein, wherein the sputtering effect upon the cathode is substantially reduced to prolong the life of the cathode, said method comprising:

applying a voltage between the cathode and the wall of the chamber;

providing a magnetic field within the chamber;

activating the cathode to emit thermal electrons therefrom within the chamber by applying a voltage thereto;

introducing a gas to be ionized into the chamber having the cathode therein;

introducing at least one active gas into the chamber having the cathode therein;

ionizing the gas to be ionized by subjecting the gas to be ionized to the thermal electrons emitted by the cathode;

regulating the voltage applied to the cathode and the voltage between the cathode and the wall of the chamber to maintain a substantially constant electric arc current flowing from the wall of the chamber to the cathode; and controlling the introduction of said at least one active gas into the chamber to maintain a predetermined mixture ratio with the gas to be ionized within the chamber to induce growth in the volume of the cathode at least partially offsetting the removal of atoms from the cathode caused by the sputtering effect.

14. A method as set forth in claim 13, wherein the introduction of said at least one active gas into the chamber is conducted simultaneously with the introduction of the gas to be ionized into the chamber.

* * * * *